US007280786B2

(12) United States Patent
Ikami et al.

(10) Patent No.: US 7,280,786 B2
(45) Date of Patent: Oct. 9, 2007

(54) ELECTROSTATIC DEVELOPING TONER

(75) Inventors: Jun Ikami, Nagoya (JP); Masateru Kawamura, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/322,229

(22) Filed: Jan. 3, 2006

(65) Prior Publication Data

US 2006/0104669 A1 May 18, 2006

Related U.S. Application Data

(63) Continuation of application No. 10/665,421, filed on Sep. 22, 2003, now abandoned.

(30) Foreign Application Priority Data

Sep. 24, 2002 (JP) ..... 2002-276739
Sep. 27, 2002 (JP) ..... 2002-282306

(51) Int. Cl.
*G03G 15/08* (2006.01)

(52) U.S. Cl. ..... 399/252; 430/106.1

(58) Field of Classification Search ..... 399/252, 399/253, 254, 255, 258; 430/106.1, 106.2
See application file for complete search history.

(56) References Cited

U.S. PATENT DOCUMENTS 4,382,420 A 5/1983 Ohnuma et al.
4,820,603 A 4/1989 Sakashita
4,946,755 A 8/1990 Inoue
4,952,476 A 8/1990 Sakashita et al.
5,296,326 A 3/1994 Taya et al.
5,411,830 A 5/1995 Matsunaga
5,422,215 A 6/1995 Takagi et al.
5,731,122 A 3/1998 Yoshida et al.
5,774,771 A 6/1998 Kukimoto et al.

(Continued)

FOREIGN PATENT DOCUMENTS

EP 0 423 743 A2 4/1991

(Continued)

OTHER PUBLICATIONS

Titan Kogyo General Products Catalogue, Jun. 2003, p. 8.

(Continued)

*Primary Examiner*—Hoan Tran
(74) *Attorney, Agent, or Firm*—Oliff & Berridge, PLC

(57) ABSTRACT

An electrostatic developing toner which can effectively suppress image fogging*1 by setting a ratio (d/D) of the average particle diameter D of the toner and the average particle diameter d of iron oxide particles contained in the toner as a colorant to within a predetermined range, and by setting the value of a ratio (σr/σs) between the residual magnetization σr and saturation magnetization σs of the iron oxide particles to a predetermined value or less, is provided. The value of the ratio (d/D) of the average particle diameter D of the toner and the average particle diameter d of iron oxide particles contained in the toner as a colorant is set to within the range of 0.01-0.03, and the value of the ratio (σr/σs) between the residual magnetization σr and saturation magnetization σs of the iron oxide particles is set to 0.3 or less.

6 Claims, 11 Drawing Sheets

U.S. PATENT DOCUMENTS

| | | | | |
|---|---|---|---|---|
| 6,128,458 | A | 10/2000 | Sato | |
| 6,141,519 | A | 10/2000 | Sato | |
| 6,337,956 | B1 | 1/2002 | Sato et al. | |
| 6,381,437 | B1 | 4/2002 | Ozawa et al. | |
| 2001/0028815 | A1 | 10/2001 | Sato | |
| 2002/0031713 | A1 | 3/2002 | Hayashi et al. | |
| 2003/0170058 | A1* | 9/2003 | Yamatani | 399/350 |

FOREIGN PATENT DOCUMENTS

| | | | |
|---|---|---|---|
| EP | 1 241 530 | A2 | 9/2002 |
| JP | A-1-116649 | | 5/1989 |
| JP | A-3-131865 | | 6/1991 |
| JP | A 05-341556 | | 12/1993 |
| JP | A 07-244396 | | 9/1995 |
| JP | A 07-261446 | | 10/1995 |
| JP | A-8-69123 | | 3/1996 |
| JP | A-8-240925 | | 9/1996 |
| JP | A-8-328312 | | 12/1996 |
| JP | A-9-311499 | | 12/1997 |
| JP | A 10-39534 | | 2/1998 |
| JP | A 10-49024 | | 2/1998 |
| JP | A-10-239896 | | 9/1998 |
| JP | A-11-7197 | | 1/1999 |
| JP | A-11-52705 | | 2/1999 |
| JP | A-11-102089 | | 4/1999 |
| JP | A 11-194557 | | 7/1999 |
| JP | A-11-327301 | | 11/1999 |
| JP | A-2000-131928 | | 5/2000 |
| JP | A 2000-184220 | | 6/2000 |
| JP | A-2000-258984 | | 9/2000 |
| JP | A-2001-166589 | | 6/2001 |
| JP | A-2001-175075 | | 6/2001 |
| JP | A-2001-337482 | | 12/2001 |
| JP | 2004-117936 | * | 4/2004 |

OTHER PUBLICATIONS

Encyclopedia of Units, Revised 4th Edition, Maruzen, May 10, 1996, p. 518.

* cited by examiner

ELECTROSTATIC DEVELOPING TONER

This is a Continuation of application Ser. No. 10/665,421 filed Sep. 22, 2003 now abandoned. The entire disclosure of the prior application is hereby incorporated by reference herein in its entirety.

BACKGROUND OF THE INVENTION

1. Field of the Invention

This invention relates to an electrostatic developing toner used in an image-forming apparatus such as a printer, copier or facsimile machine which forms an image by developing an electrostatic latent image formed on a photoconductive layer of a photoconductive drum using a toner, i.e. by an electrophotographic method. In particular, it relates to an electrostatic developing toner which can effectively suppress fogging of the image by setting a ratio (d/D) between a toner average particle diameter D and an average particle diameter d of iron oxide particles contained in the toner which function as a colorant, or by setting a ratio ($\sigma r/\sigma s$) between a residual magnetization $\sigma r$ and a saturation magnetization $\sigma s$ of the iron oxide particles. It further relates to an electrostatic developing toner which can suppress the cracking amount of the photoconductive layer on the photoconductive drum accompanying the formation of the image even after about 10000 images have been formed.

2. Description of the Related Art

In the past, various image-forming apparatuses have been proposed featuring the formation of an image by an electrophotographic method using an electrostatic developing toner, wherein an additive such as silica particulates is added to toner particles containing a colorant to develop an electrostatic latent image formed on a photoconductive layer of a photoconductive drum.

For example, JP Laid-open Patent Publication No. 05-341556 discloses a toner used in an image-forming apparatus wherein an electrostatic latent image is formed on a photoconductive layer of a latent image carrier via an optical source such as a laser, and toner is supplied to the electrostatic latent image from a toner carrier in contact with the latent image carrier to develop the electrostatic latent image. This toner is a one-component toner containing 20-50 wt % of iron oxide in a binder resin containing a colorant such as carbon black.

JP Laid-open Patent Publication No. 11-143121 discloses a toner used in an image-forming apparatus wherein an electrostatic latent image is formed on a photoconductive layer of an electrostatic latent image carrier, and the electrostatic latent image is developed by supplying toner from a developer carrier (developing roller). This toner contains a magnetic powder having a saturation magnetization $\sigma s$ of 5 $A.m^2/kg$ or less, and a residual magnetization $\sigma r$ of 3 $A.m^2/kg$ or less.

When magnetic powders such as metal oxides are added to the toner for various purposes such as suppressing image fogging, it is necessary not only to consider the amount of magnetic powder added to the toner, but also the magnetic properties of these magnetic particles such as their saturation magnetization $\sigma s$ and residual magnetization $\sigma r$.

However, although JP Laid-open Patent Publication No. 05-341556 states that the iron oxide content of the toner is 20-50 wt %, no mention is made of the other magnetic properties of the iron oxide.

JP Laid-open Patent Publication No. 11-143121 discloses that the magnetic powder added to the toner has a saturation magnetization $\sigma s$ of 5 $A.m^2/kg$ or less, and a residual magnetization $\sigma r$ of 3 $A.m^2/kg$ or less, however as in the case of No. 05-341556, no mention is made of the other magnetic properties of the magnetic powder.

JP Laid-open Patent Publication No. 11-194557 discloses an image-forming apparatus wherein a good image exposure is obtained according to a film pressure of an outermost layer of a photoconductive drum by inputting data relating to the photoconductive drum drive time and the time during which a voltage is applied to the charging roller, together with data relating to the contact pressure of a cleaning blade on a photoconductive drum from a non-volatile memory, calculating a film thickness of the outermost layer of the photoconductive drum based on this data in a control unit, and controlling the image exposure of an exposure apparatus on the photoconductive drum based on the calculated film thickness of the photoconductive drum.

In the image-forming apparatus described in JP Laid-open Patent Publication No. 11-194557, two factors are considered whereby the photoconductive layer formed on the outer circumference of the photoconductive drum may be scraped when the image is formed. The first factor is that a contact charging method is used wherein a charging roller is brought into contact with the photoconductive drum to charge the outer circumferential surface of the photoconductive drum, and the photoconductive layer on the photoconductive drum may be scraped by the charging roller when the image is formed. The other factor is that a residual toner removal method is used wherein a cleaning blade is brought into pressure contact with the photoconductive layer surface on the photoconductive drum to remove residual toner on the photoconductive drum surface after transfer of the toner image to a transfer material, and the photoconductive layer on the photoconductive drum may be scraped by the cleaning blade.

Hence, in the image-forming apparatus disclosed in JP Laid-open Patent Publication No. 11-194557, due to the design of the image-forming apparatus, the scraping of the photoconductive layer by the charging roller and the cleaning blade which are brought into contact with the circumferential surface of the photoconductive drum, are considered.

Due to the design of the image-forming apparatus, if there are members which come into contact with the circumferential surface of the photoconductive layer of the photoconductive drum, the photoconductive layer will be scraped due to the frictional contact between these members and the photoconductive layer, but these are not the only possible factors responsible for the scraping of the photoconductive layer, and it is necessary to consider scraping of the photoconductive layer by various components of the electrostatic developing toner used in the image-forming apparatus.

For example, if the colorant contained in the toner particles of the electrostatic latent image toner is a particulate pigment, its particle size and amount in the toner must be considered as possible factors in the scraping of the photoconductive layer, and if silica particulates are added to the toner particles, their particle size and addition amounts must also be considered.

SUMMARY OF THE INVENTION

As a result of intensive studies undertaken by performing experiments on the iron oxide particles contained in toner and the effect of the magnetic properties of these iron oxide particles on image-forming, the inventors discovered that the relation between toner particle size and iron oxide particle size, and the relation between the saturation magnetization us and residual magnetization σr of the iron oxide particles, had an important effect on the suppression of image fogging, and thereby arrived at the present invention. It is therefore an object of the present invention to provide an electrostatic developing toner which can effectively suppressing image fogging by setting the ratio (d/D) between the average particle diameter D of the toner and average particle diameter d of the iron oxide particles contained in the toner within a predetermined range, and setting the ratio (σr/σs) between the residual magnetization σr and saturation magnetization σs of the iron oxide particles to a predetermined value or less.

The inventors also arrived at the present invention after intensive studies undertaken by performing experiments on the effect of components of electrostatic developing toners on the scraping of the photoconductive layer on the photoconductive drum. It is therefore a further object of this invention to provide an electrostatic developing toner which can suppress the scraping amount of the photoconductive layer on the photoconductive drum when an image is formed, to a constant value or less, even after about 10000 images are formed.

The toner according to a first aspect of the invention is an electrostatic developing toner used in an image-forming apparatus wherein an electrostatic latent image is formed on a photoconductive layer formed on a circumferential surface of a photoconductive drum, and the electrostatic latent image is developed by supplying toner to the electrostatic latent image from a non-magnetic developing roller brought into contact with the photoconductive drum, wherein this electrostatic developing toner contains iron oxide particles in resin particles, and the ratio (d/D) between the average particle diameter D of the electrostatic developing toner and average particle diameter d of the iron oxide particles is within the range 0.01-0.03.

In the electrostatic developing toner according to the first aspect of the invention, the ratio (d/D) between the average particle diameter D of the electrostatic developing toner and average particle diameter d of the iron oxide particles is set within the range 0.01-0.03, so image fogging is effectively suppressed. If the value of the aforesaid ratio (d/D) departs from this range, image fogging increases.

The electrostatic developing toner according to a second aspect of the invention is an electrostatic developing toner used in an image-forming apparatus wherein an electrostatic latent image is formed on a photoconductive layer formed on a circumferential surface of a photoconductive drum, and the electrostatic latent image is developed by supplying toner to the electrostatic latent image from a non-magnetic developing roller brought into contact with the photoconductive drum, wherein this electrostatic developing toner contains iron oxide particles in resin particles, the iron oxide particles have a retentivity Hc of 3-7 kA/m in a magnetic field of 79.6 kA/m, and the ratio (σr/σs) between their residual magnetization σr and saturation magnetization σs is 0.3 or less.

In the electrostatic developing toner according to the second aspect of the invention, the iron oxide particles have a retentivity Hc of 3-7 kA/m in a magnetic field of 79.6 kA/m, and the ratio (σr/σs) of the residual magnetization σr and saturation magnetization σs in the iron oxide particles is 0.3 or less. Therefore, in a non-magnetic developing process which uses a non-magnetic developing roller, if the residual magnetization σr is small even if the saturation magnetization σs is high, the magnetic cohesive force between toner particles is weak and cohesion between toner particles can be prevented. Further, if the ratio (σr/σs) of the residual magnetization σr and saturation magnetization σs in the iron oxide particles is small, the electrostatic latent image can be developed without impairing toner fluid properties. As a result, image fogging can be effectively suppressed.

The electrostatic developing toner according to a third aspect of the invention is an electrostatic developing toner used in an image-forming apparatus wherein an electrostatic latent image is formed on a photoconductive layer having a film thickness of 30-50 μm formed on the circumferential surface of a photoconductive drum, and toner is supplied to the electrostatic latent image from a developing roller in contact with the photoconductive drum at a nip pressure of 50-350 kPa to develop the electrostatic latent image. This electrostatic developing toner contains a colorant in resin particles with the addition of at least one of a first silica particulate and a second silica particulate having mutually different particle diameters. The colorant is iron oxide having a particle diameter in the range 0.1-0.6 μm, and its addition amount is 5-10 vol % relative to toner. For the first silica particulate, the average value of the BET specific surface area is in the range 50-150 $m^2/g$, and its addition amount is 0.3-2 wt %. For the second silica particulate, the average value of the BET specific surface area is in the range 20-100 $m^2/g$, and its addition amount is 0.5-2 wt %.

In the third aspect of the invention, in the image-forming apparatus wherein the initial film thickness of the photoconductive layer of the photoconductive drum is set to the range 30-50 μm, the nip pressure of the developing roller on the photoconductive drum is set to the range 50-350 kPa, and images are formed using the electrostatic developing toner prepared above, the scraping amount of the photoconductive layer of the photoconductive drum after about 10000 images have been formed, can be suppressed to 20-40 μm or less. As a result, even after about 10000 images have been formed, the film thickness of the photoconductive layer can be maintained at 10 μm or more, and images can be formed continuously.

If the film thickness of the photoconductive layer is less than 10 μm, image fogging increases as the film thickness decreases, and as a suitable image can then no longer be obtained, it is required that the photoconductive layer has a film thickness of 10 μm or more in order to form a proper image.

The above and further objects and novel features of the invention will more fully appear from the following detailed description of the same is read in connection with the accompanying drawings. It is to be expressly understood, however, that the drawings are for the purpose of illustration only and not intended as a definition of the limits of the invention.

DETAILED DESCRIPTION OF THE PREFERRED EMBODIMENTS

The electrostatic developing toner according to the present invention will now be described in more detail based on first and second embodiments.

[Image-forming Apparatus]

Figure 1:
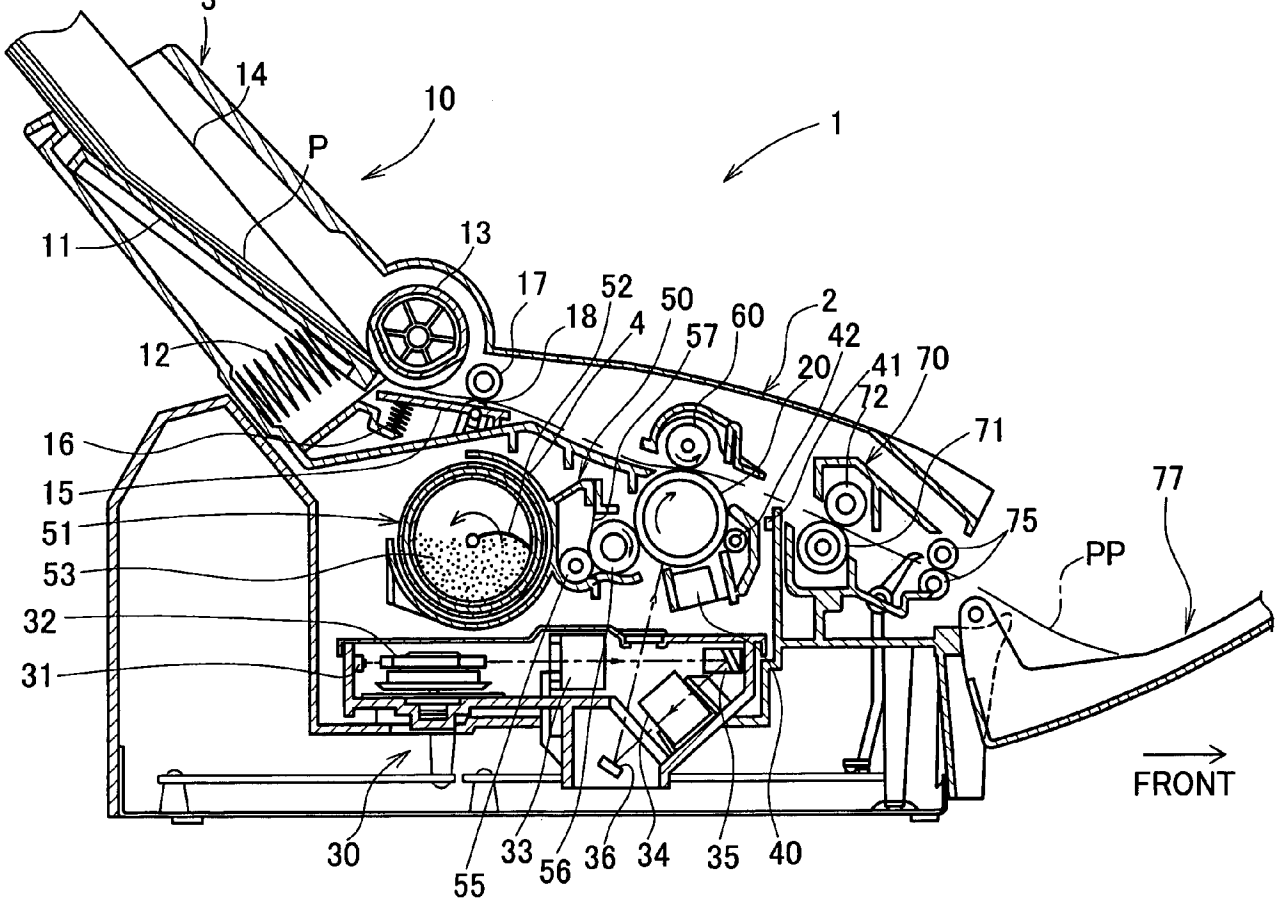
FIG. 1 is a perpendicular cross-sectional view of a laser printer.
Figure 2:
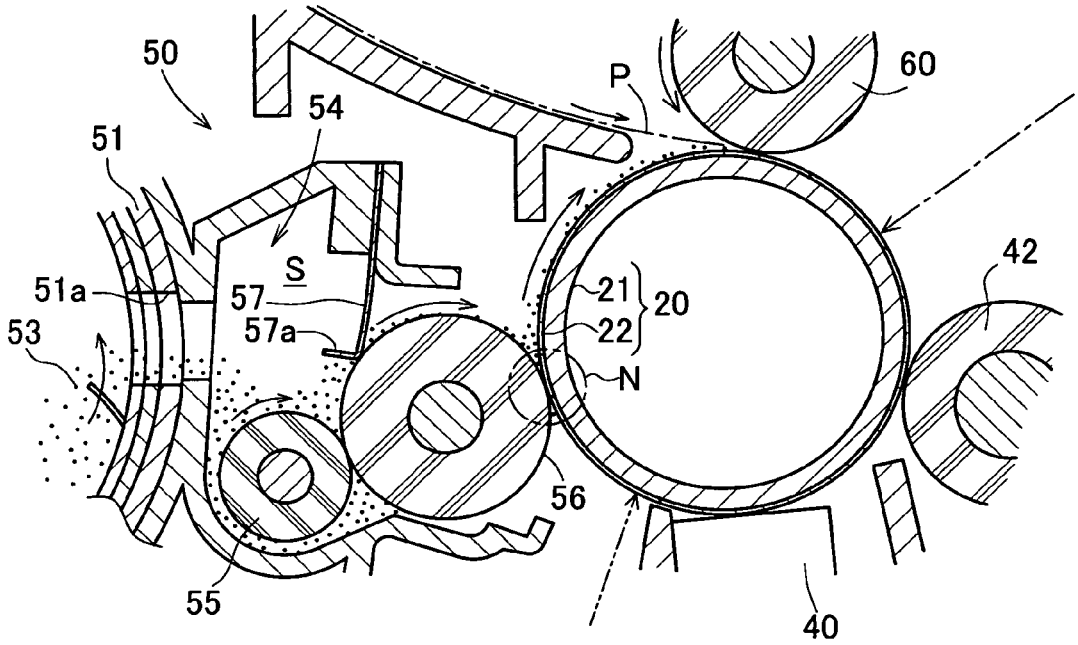
FIG. 2 is an enlarged lateral view of a developing unit and photoconductive drum of the laser printer.

First, referring to FIG. 1 and FIG. 2, a laser printer which is an image-forming apparatus using the electrostatic developing toner for the first and second embodiments will be described. FIG. 1 is a perpendicular cross-sectional view of a laser printer, and FIG. 2 is an enlarged lateral view of the developing unit and photoconductive drum part of the laser printer.

In FIG. 1, a laser printer 1 comprises a main case 2, a feeder unit 10 for feeding a paper P which is a recording medium for forming an image, a photoconductive drum 20 which is a photoconductive medium for performing the steps of charging to form an image, exposure, developing, transfer and recovery in sequence, a fixing unit 70 for fixing an image transferred from the photoconductive drum 20 to the paper P on the paper P, and a paper eject tray 77 for ejecting the paper P on which the image is fixed along a paper transport path PP.

The laser printer 1 comprises a drive means, not shown, for rotating the photoconductive drum 20. A laser scanner unit 30 for forming an electrostatic latent image on the photoconductive drum 20 rotated by the drive means, a developing unit 50 comprising a developing roller 56 for developing the electrostatic latent image formed on the photoconductive drum 20 by a toner, a transfer roller 60 for transferring the toner image developed on the photoconductive drum 20 to the paper P, a discharge lamp 41 for discharging residual potential remaining on the photoconductive drum 20 after transfer, a cleaning roller 42 for temporarily adsorbing residual toner and then discharging and leveling it on the photoconductive drum 20 after charge has been eliminated by the discharge lamp 41, so that residual toner remaining on the photoconductive drum 20 after transfer by the transfer roller 60 is returned to the developing unit 50 at a predetermined timing using the photoconductive drum 20, and a charger 40 for charging the photoconductive drum 20 so that it can form an electrostatic latent image after discharging and leveling, are disposed in sequence around the photoconductive drum 20.

The feeder unit 10 further comprises a paper pressure plate 11 disposed inside the feeder case 3 situated above the rear end of the main case 2 having substantially identical width dimensions to those of the paper P. The paper pressure plate 11 is supported free to oscillate at its rear end. A compression spring 12 is provided at the front end of the paper pressure plate 11, the paper pressure plate 11 being pushed upwards elastically by this compression spring 12. The paper pressure plate 11 supports a paper feed roller 13 extending to the left and right such that it is free to rotate. The paper feed roller 13 is rotation driven with the paper feed timing by a drive system, not shown. The feeder unit 10 houses a paper feed cassette 14 set in the feeder case 3 such that it can be freely inserted or removed obliquely, and which can accommodate plural sheets of the paper P cut to fixed dimensions. Due to the rotation of the paper feed roller 13, the paper P in the paper feed cassette 14 is supplied one sheet at a time from the uppermost sheet. Also, in order to prevent two sheets of the paper P from being transported together, the feeder unit 10 comprises a separating member 15 below the paper feed roller 13, this separating member 15 being pushed elastically against the paper feed roller 13 by a compression spring 16. A pair of resist rollers 17, 18 which grip the front edge of the paper P are respectively supported free to rotate downstream in the transport direction (in FIG. 1, from the back to the front) from the paper feed roller 13.

In FIG. 1 and FIG. 2, the photoconductive drum 20 comprises a positive charge material, for example an organic photoconductive material having a positive charge polycarbonate, as its main component. As shown in FIG. 2, the photoconductive drum 20 is a hollow drum which is cylindrical, comprising a photoconductive layer 22 of a predetermined thickness (e.g., the initial thickness is 30-15 μm) comprising a photoconductive resin dispersed in polycarbonate on the outer circumference of an aluminum cylindrical sleeve 21, and is supported free to rotate in the main case 2 such that the cylindrical sleeve 21 is earthed. In other words, the electrostatic latent image which has positive polarity (positive charge) formed on the photoconductive drum 20 is developed by developing the positive charge toner by the reverse developing method. The photoconductive drum 20 is rotation driven in the clockwise direction, viewed laterally, by a drive means.

In FIG. 1, the laser scanner unit 30 is disposed below the photoconductive drum 20, and comprises a laser imaging apparatus 31 which emits a laser L for forming an electrostatic latent image on the photoconductive drum 20, a polygon mirror (5 facepiece mirror) 32 which is rotation driven, a pair of lenses 33, 34, and a pair of reflecting mirrors 35, 36.

The charger 40 for example is a scorotron charger for positive charging which generates a corona discharge from a charging wire, for example of tungsten. In this aspect of the invention, a cleanerless method is adopted wherein the charger 40 is disposed facing the photoconductive drum 20 but not in contact with it, so that residual toner on the photoconductive drum 20 does not adhere to the charger 40.

The discharge lamp 41 inside the main case 2 for example comprises a light source such as a LED (light emitting diode), EL (electroluminescence) or a neon lamp, and the charge remaining on the photoconductive drum 20 after transfer is removed (discharged) by irradiating with a light Le.

The cleaning roller 42 varies a bias voltage so that, in a suction mode, the residual toner 53 remaining on the photoconductive drum 20 after transfer by the transfer roller 60 is first aspirated, and in a discharge mode, the aspirated residual toner 53 is discharged and leveled over the photoconductive drum 20 at a timing which does not interfere with the subsequent exposure, developing and transfer on the photoconductive drum 20. By these actions, the residual toner 53 is returned from the photoconductive drum 20 to the developing unit 50. This cleaning roller 42 may for example be a foam elastic body having electrical conductivity comprising silicone rubber or urethane rubber which permits a bias voltage to be applied.

The cleaning roller 42 is in contact with the photoconductive drum 20, and as described above, as it comprises a foam elastic body such as silicone rubber or urethane rubber, friction with the photoconductive drum 20 is reduced, and the photoconductive layer 22 on the photoconductive drum 20 is not scraped when cleaning is performed.

In FIG. 1 and FIG. 2, the developing unit 50 comprises a double cylindrical toner box 51 housed in a developer case 4 such that it can be freely inserted or removed. The toner box 51 houses an agitator 52 which is rotation driven, and the positive charge toner 53 which has electrical insulating properties. At the front of the toner box 51, a toner chamber 54 which accommodates the toner 53 supplied due to the rotation of the agitator 52 via a toner supplied port 51*a* formed in the toner box 51, is formed. The toner chamber 54 houses a supply roller 55 disposed horizontally in its longitudinal direction, and which is supported free to rotate. The developing roller 56, which is also disposed horizontally in its longitudinal direction and supported free to rotate, partitions the front of the toner chamber 54 and is in contact with the supply roller 55 and photoconductive drum 20.

The supply roller 55 comprises a foam elastic body having electrical conductivity comprising silicone rubber or urethane rubber. The developing roller 56 forms a nip N due to contact with the photoconductive drum 20 as shown in FIG. 2, and is also an electrically conducting rigid roller comprising silicone rubber or urethane rubber. The laser printer 1 of this aspect of the invention for example uses the photoconductive drum 20 comprising an organic photoconductive material having positive charge toner and positive charge polycarbonate as its main components, and urethane rubber is the material of the developing roller 56.

As shown in FIG. 2, the photoconductive drum 20 is rotated clockwise and the developing roller 56 is also rotated clockwise. A rotation direction of the photoconductive drum 20 and that of the developing roller 56 are opposite to each other at the nip N. This means circumferential speed difference becomes large. As circumferential speed difference becomes larger, amount of toner 53 the developing roller 56 can deliver to the photoconductive drum 20 becomes larger. In other words, even if amount of toner 53 carried onto the circumferential surface of the developing roller 56 is small, i.e., even if layer thickness of toner 53 is thin, constant amount of toner 53 can stably be delivered to the photoconductive drum 20. This mechanism can make layer thickness of toner 53 carried onto the developing roller 56 thin. Therefore, toner 53 can be charged uniformly and image quality can be improved.

The nip pressure (contact pressure) of the developing roller 56 with the photoconductive drum 20 is set within the range 50-350 kPa. If this nip pressure falls below 50 kPa, the offset of the developing roller 56 appears directly in the image, and gives rise to image distortion. Conversely, if the nip measure is more than 350 kPa, the torque which drives the developing roller 56 is excessive, and interferes with the drive.

As shown in FIG. 2, the toner chamber 54 is provided in the developer case 4 in the developing unit 50, this toner chamber 54 being formed such that there is a large upper gap S above the supply roller 55.

In FIG. 1 and FIG. 2, a layer thickness regulating blade 57 comprised of a thin stainless steel or copper plate with elasticity is installed facing downwards in the developer case 4.

A curved part 57*a* formed at the bottom of the layer thickness regulating blade 57 is in contact with the developing roller 56 such that it presses against it, and the layer thickness of the toner 53 supplied from the supply roller 55 and adhering as a layer to the surface of the developing roller 56, is regulated by this layer thickness regulating blade 57 to a predetermined thickness (approximately 7-12 μm).

The transfer roller 60, which is installed in contact with the upper side of the photoconductive drum 20 and is supported free to rotate, comprises a foam elastic body having electrical conductivity comprising silicone rubber or urethane rubber.

The fixing unit 70, which is installed downstream of the photoconductive drum 20 in the transport direction, and comprises a heating roller 71 and pressure roller 72 housing a halogen lamp known in the art, fixes the toner image transferred to the underside of the paper P by heat and pressure so as to fix it on the paper P.

A pair of transport rollers 75 for transporting the paper and the paper eject tray 77 are respectively installed downstream of the fixing unit 70 in the transport direction.

Furthermore, as shown in FIG. 1, the paper supply roller 13, photoconductive drum 20, fixing unit 70 and paper eject tray 77 transport the paper P supplied from the paper cassette 14 along the substantially linear paper transport path PP.

First Embodiment

[Toner]

The toner according to present aspect of the invention is a positive charge toner, for example a non-magnetic one component toner comprising a polymer resin of styrene acrylate or the like, the proportion of iron oxide having substantially spherical particles which functions as a colorant in the polymer resin toner particles is 4-7 vol % relative to toner, and various additives such as two types of silica particulates having different particle sizes to confer fluidity, and a wax and a charge controlling agent, are added.

In addition to the aforesaid polymer toner, a powdered toner may also be used.

Herein, as the iron oxide particles have a substantially spherical shape, the toner can be uniformly charged unlike the case where they have different shapes, and image fogging can be effectively suppressed. Also, as the iron oxide particles which act as a colorant account for 4-7 vol % of the toner, image fogging is suppressed and the image can be formed with a suitable print density. If the iron oxide particle content is within the range 4-7 vol %, the scraping amount of the photoconductive layer of the photoconductive drum due to the iron oxide particles in image-forming can be suppressed to within tolerance limits.

Next, six types of iron oxide particles having different retentivity Hc, saturation magnetization σs, residual magnetization σr and average particle diameter d were manufactured, six types of toner containing these iron oxide particles were prepared (Examples 1-4, Comparative Examples 1, 2), and the fogging value in the initial stage of image-forming and the fogging value after printing 6000 sheets were measured for each toner.

The retentivity Hc, saturation magnetization σs, residual magnetization σr and average particle diameter d of the iron oxide particles used in the toners of Examples 1-4, and Comparative Examples 1, 2, and the toner average particle diameter D measured for each toner, are listed in the following Table 1.

TABLE 1

| Toner | Fogging | Measured magnetic field 1 kOe (=79.6 kA/m) Hc(oe) | Hc(kA/m) | σs($Am^2$/kg) | σs($Am^2$/kg) | σr/σs | Particle diameter d | Toner diameter D | d/D |
|---|---|---|---|---|---|---|---|---|---|
| Example 1 | 0.35 | 59 | 4.70 | 66.7 | 5 | 0.07 | 0.22 | 9.155 | 0.024 |
| | 1.01 | 59 | 4.70 | 66.7 | 5 | 0.07 | 0.22 | 9.155 | 0.024 |
| Example 2 | 1.13 | 85 | 6.77 | 65 | 8.7 | 0.13 | 0.13 | 9.220 | 0.014 |
| | 1.29 | 85 | 6.77 | 65 | 8.7 | 0.13 | 0.13 | 9.220 | 0.014 |
| Example 3 | 0.56 | 93 | 7.40 | 66 | 9.3 | 0.14 | 0.19 | 8.907 | 0.021 |
| | 1.03 | 93 | 7.40 | 66 | 9.3 | 0.14 | 0.19 | 8.907 | 0.021 |
| Example 4 | 1.17 | 114 | 9.07 | 59.6 | 10 | 0.17 | 0.23 | 9.041 | 0.025 |
| | 1.20 | 114 | 9.07 | 59.6 | 10 | 0.17 | 0.23 | 9.041 | 0.025 |
| Comparative | 2.39 | 283 | 22.5 | 0.6 | 0.2 | 0.33 | 0.3 | 8.832 | 0.034 |
| Example 1 | 3.11 | 283 | 22.5 | 0.6 | 0.2 | 0.33 | 0.3 | 8.832 | 0.034 |
| Comparative Example 2 | 5.06 | 58 | 4.62 | 0.2 | 0.1 | 0.50 | 0.017 | 9.240 | 0.002 |

1. Toners in the Examples

(1) EXAMPLE 1

Table 1 shows the physical properties for the iron oxide particles used in the toner of Example 1.

(Retentivity Hc (kA/m))

The retentivity Hc, measured at a measured magnetic field of 1 kOe (97.6 kA/m) was 4.70 kA/m (59 eO).

(Saturation Magnetization σs and Residual Magnetization σr)

The saturation magnetization us was 66.7 $Am^2$/kg, and the residual magnetization σr was 5 $Am^2$/kg. Hence, the ratio (σr/σs) of the residual magnetization σr and saturation magnetization σs was 0.07.

(Average Particle Diameter d of Iron Oxide and Average Particle Diameter D of Toner)

The average particle diameter d of iron oxide particles was 0.22 μm. The average particle diameter D of the final toner was 9.155 μm. Hence, the ratio (d/D) of the average particle diameter d of iron oxide particles to the average particle diameter D of toner was 0.024.

For the aforesaid toners, the initial fogging value when images were first formed was 0.35, and the fogging value after 6000 sheets had been printed was 1.01.

In general, it is said that the fogging value must be 2.0 or less. Hence, the fogging value measured for the toner in Example 1 was within the permitted range for both the initial value and after printing 6000 sheets, and fogging was suppressed.

(2) EXAMPLE 2

Table 1 shows various physical properties for the iron oxide particles used in the toner of Example 2.

(Retentivity Hc (kA/m))

The retentivity Hc measured at a measured magnetic field of 1 kOe (97.6 kA/m) was 6.77 kA/m (85 eO).

(Saturation Magnetization σs and Residual Magnetization (σr)

The saturation magnetization σs was 65 $Am^2$/kg, and the residual magnetization σr was 8.7 $Am^2$/kg. Hence, the ratio (σr/σs) of the residual magnetization σr and saturation magnetization σs was 0.13.

(Average Particle Diameter d of Iron Oxide and Average Particle Diameter D of Toner)

The average particle diameter d of iron oxide particles was 0.13 μm. The average particle diameter D of the final toner was 9.220 μm. Hence, the ratio (d/D) of the average particle diameter d of iron oxide particles to the average particle diameter D of toner was 0.014.

For the aforesaid toners, the initial fogging value when images were first formed was 1.13, and the fogging value after 6000 sheets had been printed was 1.29.

In general, it is said that the fogging value must be 2.0 or less. Hence, the fogging value measured for the toner in Example 2 was within the permitted range for both the initial value and after printing 6000 sheets, and fogging was suppressed.

(3) EXAMPLE 3

Table 1 shows various physical properties of the iron oxide particles used in the toner of Example 3.

(Retentivity Hc (kA/m))

The retentivity Hc measured at a measured magnetic field of 1 kOe (97.6 kA/m) was 7.40 kA/m (93 eO).

(Saturation Magnetization σs and Residual Magnetization σr)

The saturation magnetization σs was 66 $Am^2$/kg, and the residual magnetization σr was 9.3 $Am^2$/kg. Hence, the ratio (σr/σs) of the residual magnetization σrand saturation magnetization σs was 0.14.

(Average Particle Diameter d of Iron Oxide and Average Particle Diameter D of Toner)

The average particle diameter d of iron oxide particles was 0.22 μm. The average particle diameter D of the final toner was 8.907 μm. Hence, the ratio (d/D) of the average particle diameter d of iron oxide particles to the average particle diameter D of toner was 0.021.

For the aforesaid toners, the initial fogging value when images were first formed was 0.56, and the fogging value after 6000 sheets had been printed was 1.03.

In general, it is said that the fogging value must be 2.0 or less. Hence, the fogging value measured for the toner in Example 3 is within the permitted range for both the initial value and after printing 6000 sheets, and fogging is suppressed.

(4) EXAMPLE 4

Table 1 shows various physical properties of the iron oxide particles used in the toner of Example 4.

(Retentivity Hc (kA/m))

The retentivity Hc measured at a measured magnetic field of 1 kOe (97.6 kA/m) was 9.07 kA/m (114 eO).

(Saturation Magnetization σs and Residual Magnetization σr)

The saturation magnetization σs was 59.6 $Am^2/kg$, and the residual magnetization σr was 10 $Am^2/kg$. Hence, the ratio (σr/σs) of the residual magnetization σr and saturation magnetization σs was 0.17.

(Average Particle Diameter d of Iron Oxide and Average Particle Diameter D of Toner)

The average particle diameter d of iron oxide particles was 0.23 μm. The average particle diameter D of the final toner was 9.041 μm. Hence, the ratio (d/D) of the average particle diameter d of iron oxide particles to the average particle diameter D of toner was 0.025.

For the aforesaid toners, the initial fogging value when images were first formed was 1.17, and the fogging value after 6000 sheets had been printed was 1.20.

In general, it is said that the fogging value must be 2.0 or less. Hence, the fogging value measured for the toner in Example 4 is within the permitted range for both the initial value and after printing 6000 sheets, and fogging is suppressed.

2. Toners in the Comparative Examples (1) COMPARATIVE EXAMPLE 1

Table 1 shows various physical properties of the iron oxide particles used in the toner of Comparative Example 1.

(Retentivity Hc (kA/m))

The retentivity Hc measured at a measured magnetic field of 1 kOe (97.6 kA/m) was 22.5 kA/m (283 eO).

(Saturation Magnetization σs and Residual Magnetization σr)

The saturation magnetization σs was 0.6 $m^2/kg$, and the residual magnetization σr was 0.2 $Am^2/kg$. Hence, the ratio (σr/σs) of the residual magnetization σr and saturation magnetization σs was 0.33.

(Average Particle Diameter d of Iron Oxide and Average Particle Diameter D of Toner)

The average particle diameter d of iron oxide particles was 0.3 μm. The average particle diameter D of the final toner was 8.832 μm. Hence, the ratio (d/D) of the average particle diameter d of iron oxide particles to the average particle diameter D of toner was 0.034.

For the aforesaid toners, the initial fogging value when images were first formed was 2.39, and the fogging value after 6000 sheets had been printed was 3.11.

In general, it is said that the fogging value must be 2.0 or less. Hence, the fogging value measured for the toner in Comparative Example 1 largely departs from the permitted range for both the initial value and after printing 6000 sheets, and fogging is not sufficiently suppressed.

(2) COMPARATIVE EXAMPLE 2

Table 1 shows various physical properties of the iron oxide particles used in the toner of Comparative Example 2.

(Retentivity Hc (kA/m))

The retentivity Hc measured at a measured magnetic field of 1 kOe (97.6 kA/m) was 4.62 kA/m (58 eO).

(Saturation Magnetization σs and Residual Magnetization σr)

The saturation magnetization σs was 0.2 $Am^2/kg$, and the residual magnetization σr was 0.1 $Am^2/kg$. Hence, the ratio (σr/σs) of the residual magnetization σr and saturation magnetization σs was 0.5.

(Average Particle Diameter d of Iron Oxide and Average Particle Diameter D of Toner)

The average particle diameter d of iron oxide particles was 0.017 μm. The average particle diameter D of the final toner was 9.240 μm. Hence, the ratio (d/D) of the average particle diameter d of iron oxide particles to the average particle diameter D of toner was 0.002.

For the aforesaid toners, the initial fogging value when images were first formed was 5.06. This fogging value largely departs from the permitted range for the initial value (2.0), and image fogging is not completely suppressed even before printing 6000 sheets.

Figure 3:
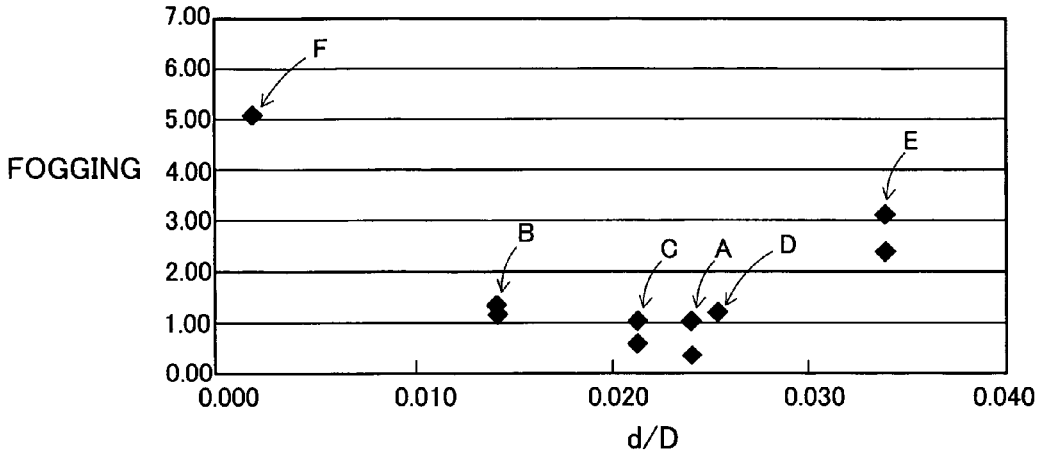
FIG. 3 is a graph showing a relation between the value of a ratio (d/D) and a fogging value.

3. Relation Between Ratio (d/D) of Iron Oxide Average Particle Diameter d and Toner Particle Average Particle Diameter D, to Fogging Value To examine the relation between the ratio (d/D) of the iron oxide average particle diameter d and toner particle average particle diameter D, to the fogging value, the relation between the ratio (d/D) to the fogging value was plotted based on Table 1. FIG. 3 shows the results. FIG. 3 is a graph showing the relation of the ratio (d/D) to the fogging value. The horizontal axis shows the value of the ratio (d/D), and the vertical axis shows the fogging value.

In FIG. 3, A, B, C, D are the plots obtained respectively for Example 1, Example 2, Example 3, Example 4, and E, F are the plots obtained respectively for Comparative Example 1 and Comparative Example 2.

As the fogging value must be 2.0 or less, in order to effectively suppress image fogging, as seen from FIG. 3, the value of the ratio (d/D) of the iron oxide average particle diameter d and toner particle average particle diameter D, must lie within the range 0.010-0.030. If the value of the ratio (d/D) is 0.030 or more, or 0.010 or less, the fogging value is 2.0 or more, and image fogging can no longer be effectively suppressed.

Figure 4:
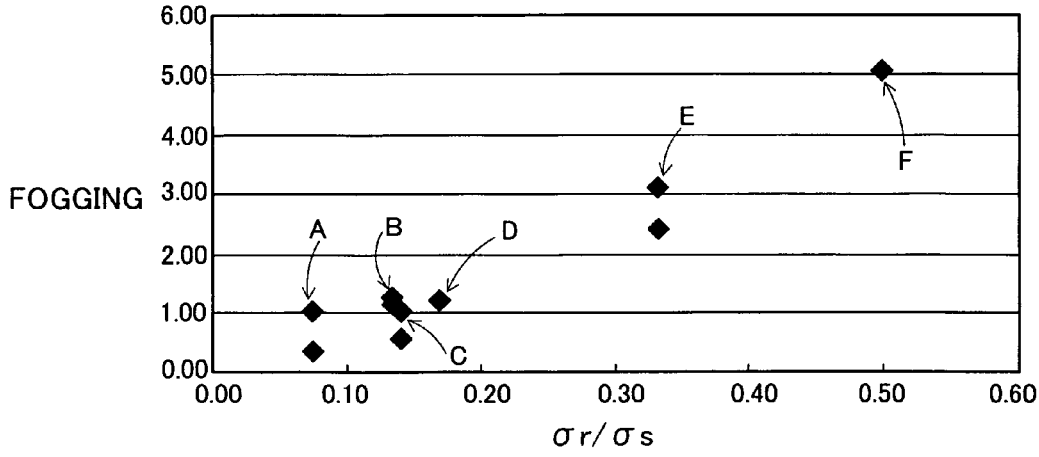
FIG. 4 is a graph showing a relation between the value of a ratio (σr/σs) and a fogging value.

4. Relation Between Ratio (σr/σs) of Saturation Magnetization σs and Residual Magnetization σr, to Fogging Value To examine the relation between the ratio (σs/σr) of the saturation magnetization σs and the residual magnetization σr to the fogging value, the relation between the value of the ratio (σr/σs) and the fogging value was plotted. FIG. 4 shows the results. FIG. 4 is a graph showing the relation between the value of the ratio (σr/σs) and the fogging value. The horizontal axis shows the value of the ratio (σr/σs), and the vertical axis shows the fogging value.

In FIG. 4, A, B, C, D are the plots obtained respectively for Example 1, Example 2, Example 3, Example 4, and E, F are the plots obtained respectively for Comparative Example 1 and Comparative Example 2.

As the fogging value must be 2.0 or less, in order to effectively suppress image fogging, as seen from FIG. 4, the value of the ratio (σr/σs) of the saturation magnetization σs and the residual magnetization σr, must be 0.03 or less. If the value of the ratio (σr/σs) is 0.030 or more, the fogging value is 2.0 or more, and image fogging can no longer be effectively suppressed.

If the value of the ratio (σr/σs) is 0.03 or less, in the non-magnetic developing process using a non-magnetic developing roller, if the residual magnetization σr is small even if the saturation magnetization σs is large, the magnetic cohesive force between toner particles is weak and cohesion of toner particles can be prevented, and if the ratio (σr/σs) of the residual magnetization σr and saturation magnetization σs is small, the electrostatic latent image can be developed without impairing toner fluid properties. As a result, image fogging can be effectively suppressed.

On the other hand, if the residual magnetization or is small and the saturation magnetization σs is also small (the ratio (σr/σs) of the two is large), the magnetizing force of the iron oxide itself is weak, and as the charging of the toner overall is non-uniform, image fogging easily occurs.

In the electrostatic developing toner of the first embodiment described above, the ratio (d/D) between the average particle diameter D of the toner and the average particle diameter d of the iron oxide particles contained in the toner which function σs a colorant, is set to within the range 0.01-0.03, and the ratio (or/as) between the residual magnetization σr and saturation magnetization σs of the iron oxide particles is set to 0.3 or less. Hence, an electrostatic developing toner which effectively suppresses image fogging can be provided.

Second Embodiment

An electrostatic developing toner according to a second embodiment will now be described. The image-forming apparatus according to this aspect, and its construction and function, do not differ from the image-forming apparatus according to the first aspect, so their description will not be repeated. Identical parts are also assigned identical numbers to those of the first aspect.

[Toner]

The toner 53 according to this aspect may for example be a non-magnetic one-component toner comprising a polymer resin of styrene acrylate or the like having a substantially spherical shape. The polymer resin toner particles contain iron oxide particles which function as a colorant, and various additives such as two types of silica particulates of mutually different particle diameters which impart fluidity (hereafter, the silica of small particle diameter will be referred to as Silica A, and the silica of large particle diameter will be referred to as Silica B), a wax and a charge controlling agent. Silica A acts mainly to improve toner fluidity, while toner B prevents adhesion between toner particles. Due to the combined effect of these two types of silica, image fogging and image dropout are prevented, and image quality is improved. In addition to the aforesaid polymer toner, the toner may also contain crushed toner.

Next, for the toner 53 used in the laser printer 1 wherein the initial film thickness of the layer 22 formed on the circumferential surface of the photoconductive drum 20 is set within the range 30-50 μm, and the nip pressure of the developing roller 56 on the photoconductive film 20 is on the photoconductive drum 20 is set within the range 50-350 kPa, function expressions were deduced between the particle size and content of iron oxide particles in the toner particles forming the toner, the addition amount and particle size of Silica A and Silica B, and the scraping amount of the photoconductive layer 22. Next, the scraping amount of the photoconductive layer 22 and the value of the function expressions when the particle size of the iron oxide particles and addition amounts of Silica A and Silica B were varied, were compared.

A. Deduction of Function Expression (1) Assumptions in the Deduction (i) Assumptions Concerning the Structure of the Laser Printer As is clear from the structure of the laser printer 1, the cleaning roller 42, developing roller 56 and transfer roller 60 are in contact with the photoconductive layer 22 of the photoconductive drum 20. As the cleaning roller 42 is made of a foam elastic material such as silicone rubber or urethane rubber, friction with the photoconductive drum 20 is reduced, and the photoconductive layer 22 of the photoconductive drum 20 is not scraped when cleaning is performed. Further, as the transfer roller 60 likewise comprises a foam elastic material having electrical conductivity such as silicone rubber or urethane rubber, the photoconductive layer 22 of the photoconductive drum 20 is not scraped when the image is transferred to the paper P. On the other hand, the developing roller 56 is a rigid roller made of urethane rubber, and when toner 53 adhering to the surface of the developing roller 56, adheres to the electrostatic latent image on the photoconductive layer 22 to develop it, the photoconductive layer 22 is probably scraped depending on the nip pressure of the developing roller 56 which is brought into the nip part N.

Hence, the structural element of the laser printer 1 leading to scraping of the photoconductive layer 22 of the photoconductive drum 20, will be assumed to be the developing roller 56. The scraping amount of the photoconductive layer 22 varies according to a predetermined function having the nip pressure of the developing roller 56 on this photoconductive layer 22 as a parameter.

(ii) Assumptions Concerning the Toner Composition

The toner comprises polymer resin toner particles containing iron oxide particles as colorant. These polymer resin toner particles contain the additives Silica A and Silica B, and other additives required for the toner composition such as a wax and a charge controlling agent.

It will be assumed that the toner components which scrape the photoconductive layer 22 on the photoconductive drum 20 are the iron oxide particles, Silica A and Silica B which are harder than the photoconductive layer 20, and that the scraping amount of the photoconductive layer 22 varies according to a predetermined function having the particle diameter and content of the iron oxide particles, and the particle diameter and addition amounts of Silica A and Silica B, as parameters.

(iii) Lower Limit of Photoconductive Layer

Figure 5:
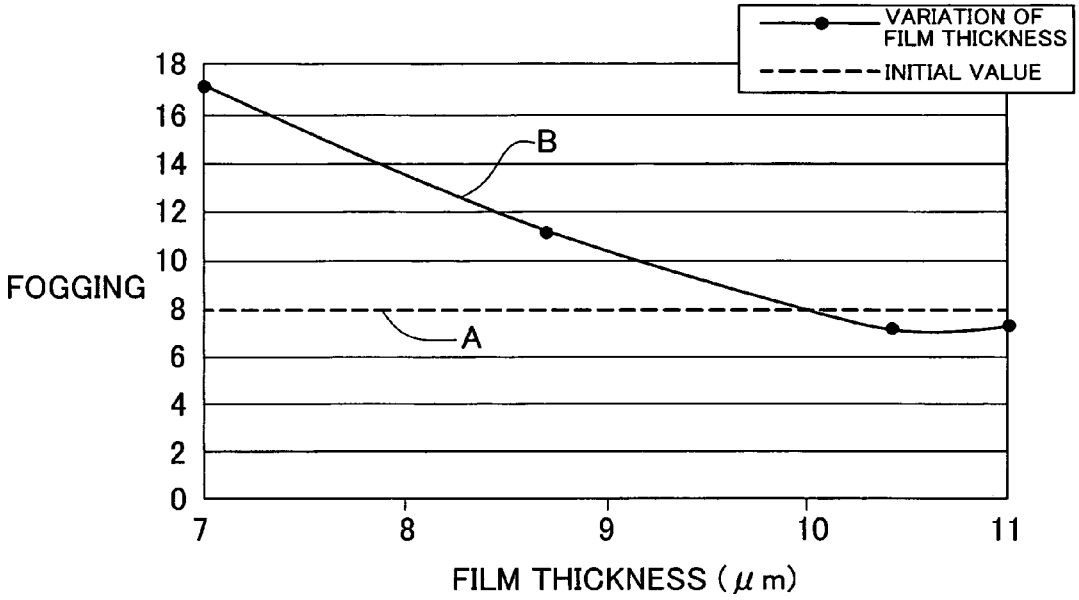
FIG. 5 is a graph showing a relation between a film thickness of a photoconductive layer and fogging.

In order to determine the lower limit of the photoconductive layer required for image-forming, the relation between the film thickness of the photoconductive layer and image fogging was examined. FIG. 5 shows the results. FIG. 5 is a graph showing a relation between film thickness of the photoconductive layer and fogging, the horizontal axis showing the film thickness of the photoconductive layer and the vertical axis showing the fogging value.

In FIG. 5, graph A shows the initial value for fogging obtained by measuring the fogging using a new photoconductive drum and toner. It is seen that the initial value of fogging is 8 which is within the measurement range, and has not changed.

On the other hand, graph B shows the variation of the fogging value obtained using plural used photoconductive drums having photoconductive films of different film thickness and new toners. It is seen that when the film thickness of the photoconductive film is from 11 μm to 10 μm, the fogging value is 8 or less which is satisfactory, but if the film thickness is less than 10 μm, the fogging increases beyond 8 as the film thickness decreases. This is thought to be due to the fact that when the film thickness of the photoconductive film decreases below 10 μm, there is a drop in potential due to a decrease of insulating properties or charging capacity.

From the above, it is seen that the lower limit of film thickness of the photoconductive film required to form an image must be 10 μm.

(iv) Relation Between Print Duty and Scraping Amount of Photoconductive Film

To examine the relation between print duty and scraping amount of the photoconductive film, the following measurements were performed.

Figure 6:
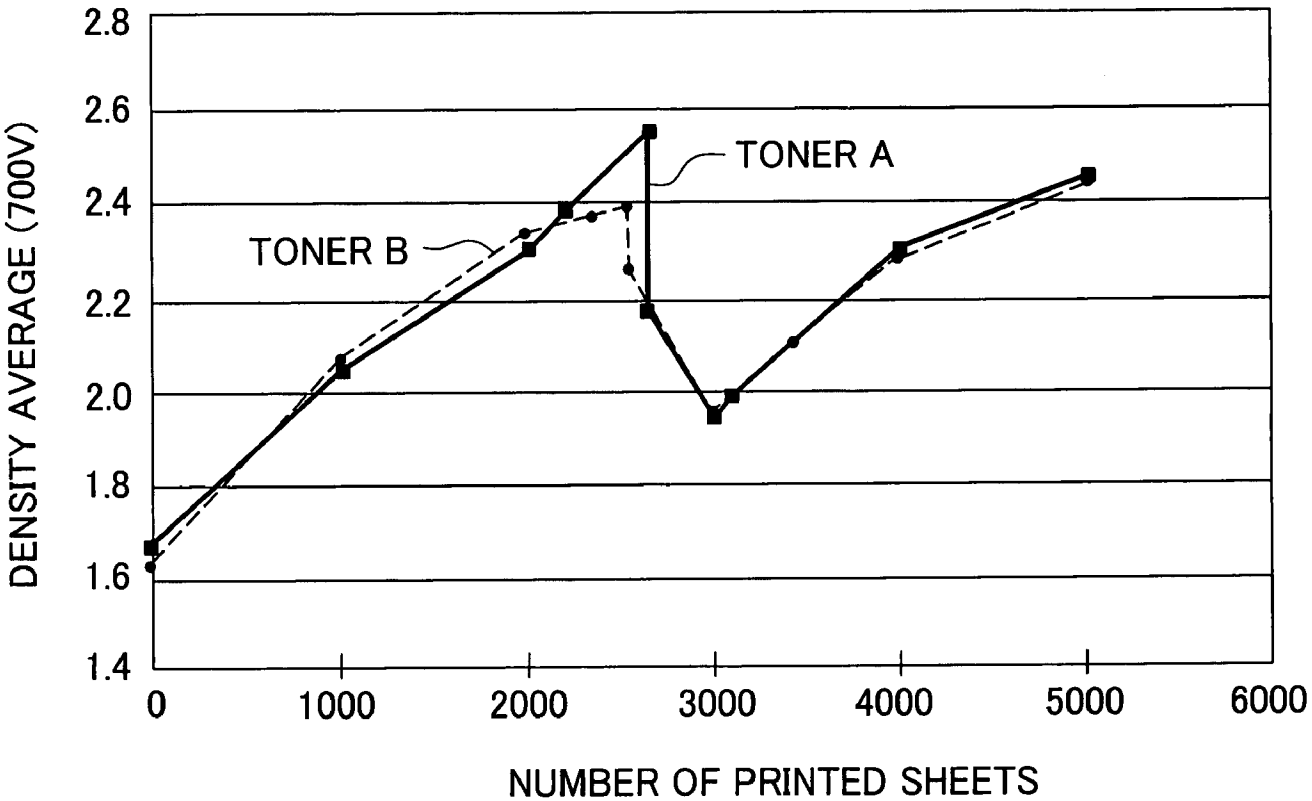
FIG. 6 is a graph showing a relation between a number of printed sheets and print density during endurance printing for two toners A and B.

First, endurance printing was performed using two toners A and B (toners having an identical particle size but different colorants, the remaining components being identical), and the relation between number of printed sheets and print density was examined. FIG. 6 shows this measurement result. FIG. 6 is a graph showing the relation between the number of printed sheets and print density during endurance printing using the two toners A and B. As shown in FIG. 6, during endurance printing with toner A and toner B, there is a large variation of print density from 2000 to 3000 printed sheets. In other words, there is a large variation of print duty during endurance printing.

Figure 7:
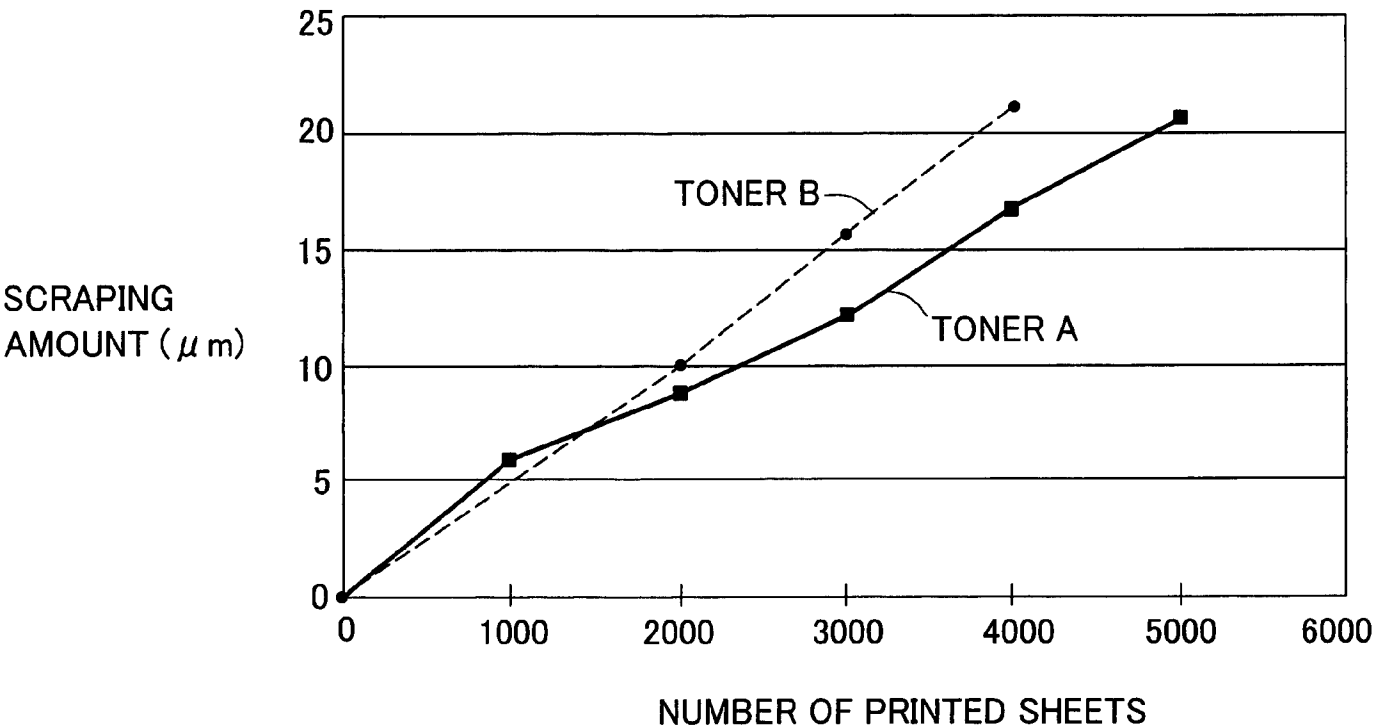
FIG. 7 is a graph showing a relation between the number of printed sheets and a scraping amount of the photoconductive layer during endurance printing for the two toners A and B.

Next, endurance printing was performed in the same way using the two toners A and B, and the relation between the number of printed sheets and scraping amount of the photoconductive layer was measured. FIG. 7 shows this measurement result. FIG. 7 is a graph showing the relation between the number of printed sheets and the scraping amount of the photoconductive layer for the two toners A and B. As shown in FIG. 7, there is a substantially linear variation according to the increase in the number of printed sheets for both toner A and toner B, and there is a large variation from 2000 to 3000 printed sheets.

As is clear from a comparison of the graph of FIG. 4 and the graph of FIG. 7, there is no correlation between print duty and scraping amount of the photoconductive layer. Therefore, print duty will not be considered in deducing the functional relations below concerning scraping amount of the photoconductive layer.

(2) Deduction of Functional Relations (i) As discussed in the above, the toner components which affect the scraping amount of the photoconductive layer are iron oxide particles, Silica A and Silica B. First, it will be considered how these components affect the scraping of the photoconductive layer. In the following, Silica A, Silica B and iron oxide particles will be considered in that order.

(ii) Silica A

For Silica A, silica having a BET specific surface area of 100 $m^2/g$ was used. To examine the effect of this Silica A on the scraping of the photoconductive layer, carbon black was used as a colorant, a toner containing neither Silica A nor Silica B was prepared, and the scraping amount of the photoconductive layer was measured using this toner at a developing roller nip pressure of 290 kPa. As a result of this measurement, it was found that this toner did not contribute to scraping of the photoconductive layer. This confirms that the carbon black used as colorant does not contribute to scraping of the photoconductive layer.

Figure 8:
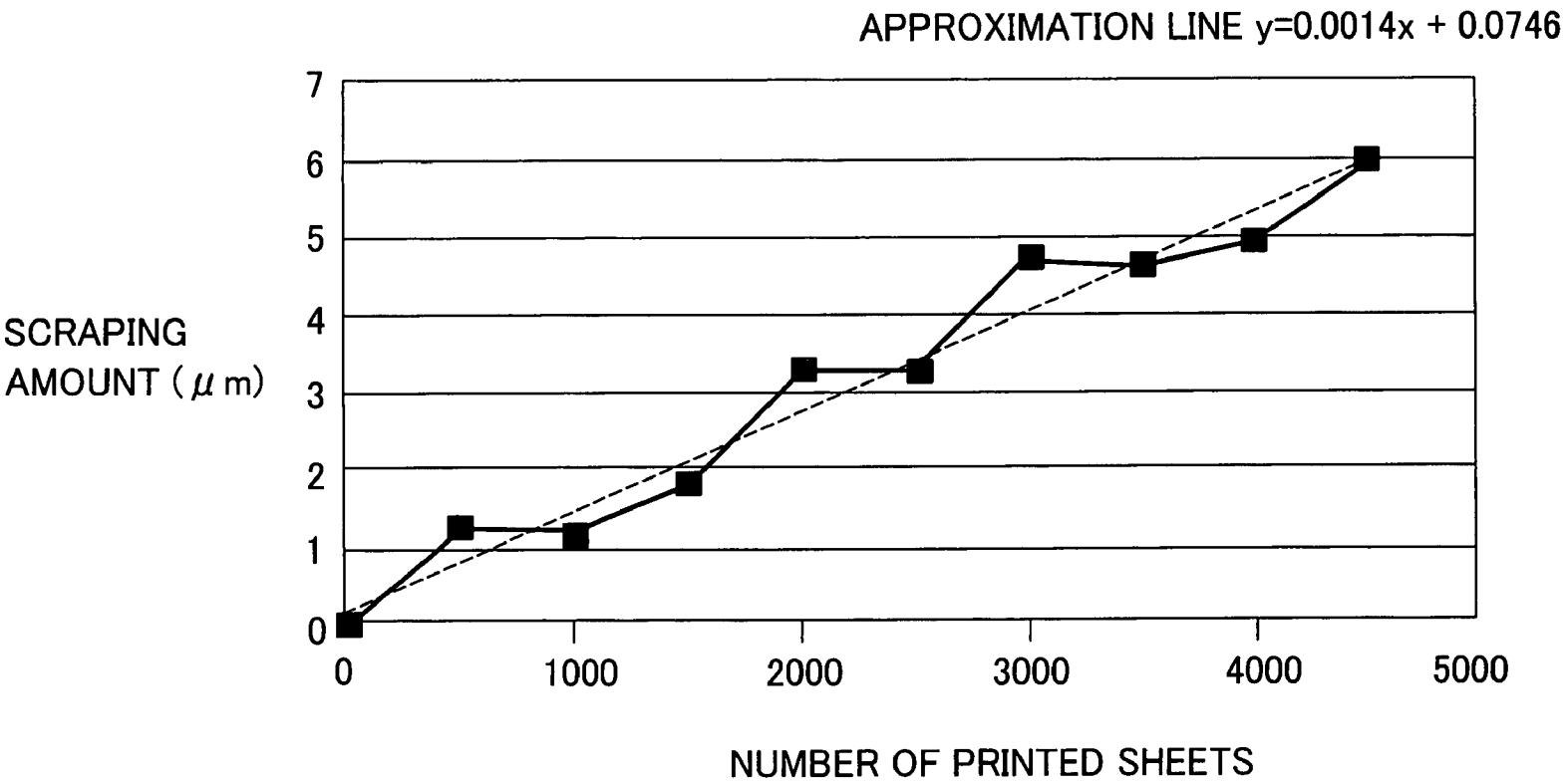
FIG. 8 is a graph showing a relation between the number of printed sheets and the scraping amount of the photoconductive layer p.

Next, using carbon black as colorant, a toner containing 1% (wt %) of Silica A was prepared, and the relation between the number of printed sheets and the scraping amount of the photoconductive layer was measured at a developing roller nip pressure of 290 kPa. FIG. 8 shows this measurement result. FIG. 8 is a graph showing the relation between the number of printed sheets and the scraping amount of the photoconductive layer. The horizontal axis shows number of sheets, and the vertical axis shows the scraping amount.

In FIG. 8, the scraping amount of the photoconductive layer tends to increase linearly with increase in the number of printed sheets. If an approximation relation is fitted to the measurement points on the graph, the following Equation 1 is obtained.

$$y=0.0014x+0.0746 \quad \text{[Equation 1]}$$

Based on Equation 1, the scraping amount of the photoconductive layer after printing 6000 sheets was computed as 8.5 μm.

Figure 9:
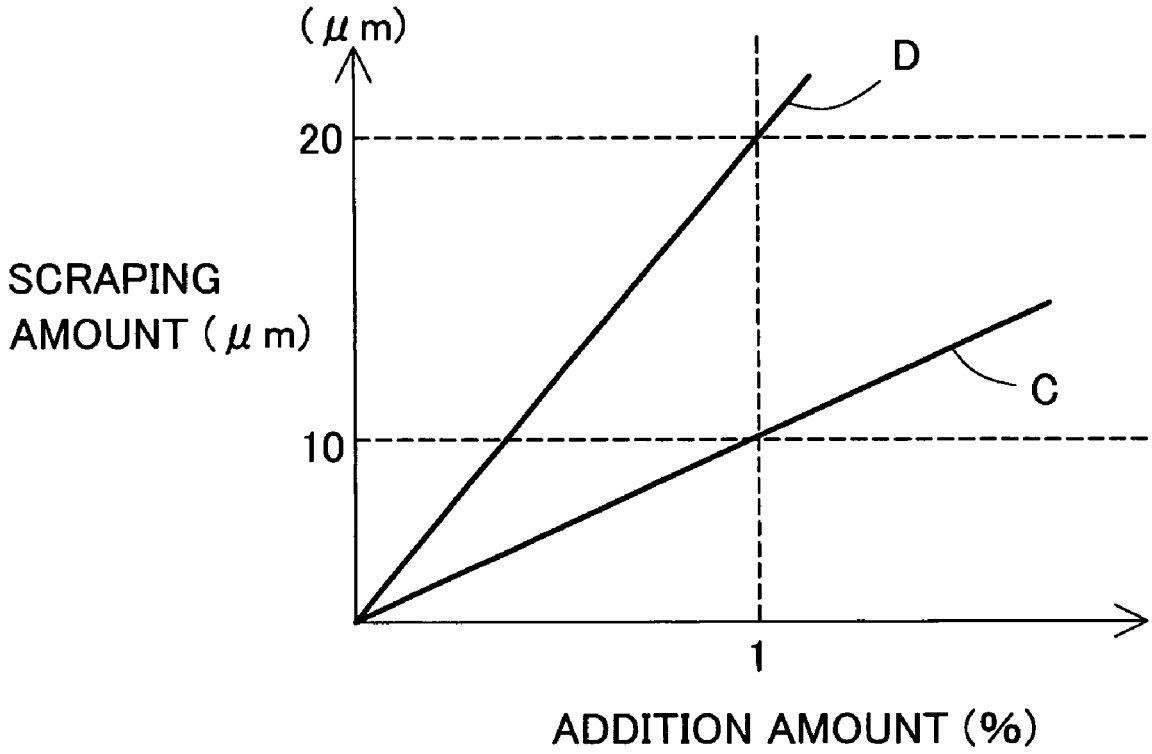
FIG. 9 is a graph showing a linear plot of a relation between addition amounts of a Silica A and a Silica B, and the scraping amount of the photoconductive layer.

Here, it was found that when Silica A and Silica B are not added (addition amount 0%), there is no scraping of the photoconductive layer, therefore concerning the equation representing the scraping amount of the photoconductive layer, there is no problem in assuming the linear plot passing through the origin shown in graph C of FIG. 9.

In practice, when the addition amounts of Silica A and Silica B are 0%, filming occurs so the intercept on graph C of FIG. 9 may be considered to be slightly negative, but herein, it will be assumed that a more stringent condition (intercept=0 μm) is used.

Hence, in the graph C of FIG. 9, if x% of Silica A is added, the scraping amount of the photoconductive layer after printing 1000 sheets is given by the following Equation 2.

$$1.4x\ (\mu m) \quad \text{[Equation 2]}$$

In Equation 2, the coefficient 1.4 is a coefficient obtained by converting the scraping amount of 8.5 μm per 6000 sheets, to 1000 sheets.

(iii) Silica B

Figure 10:
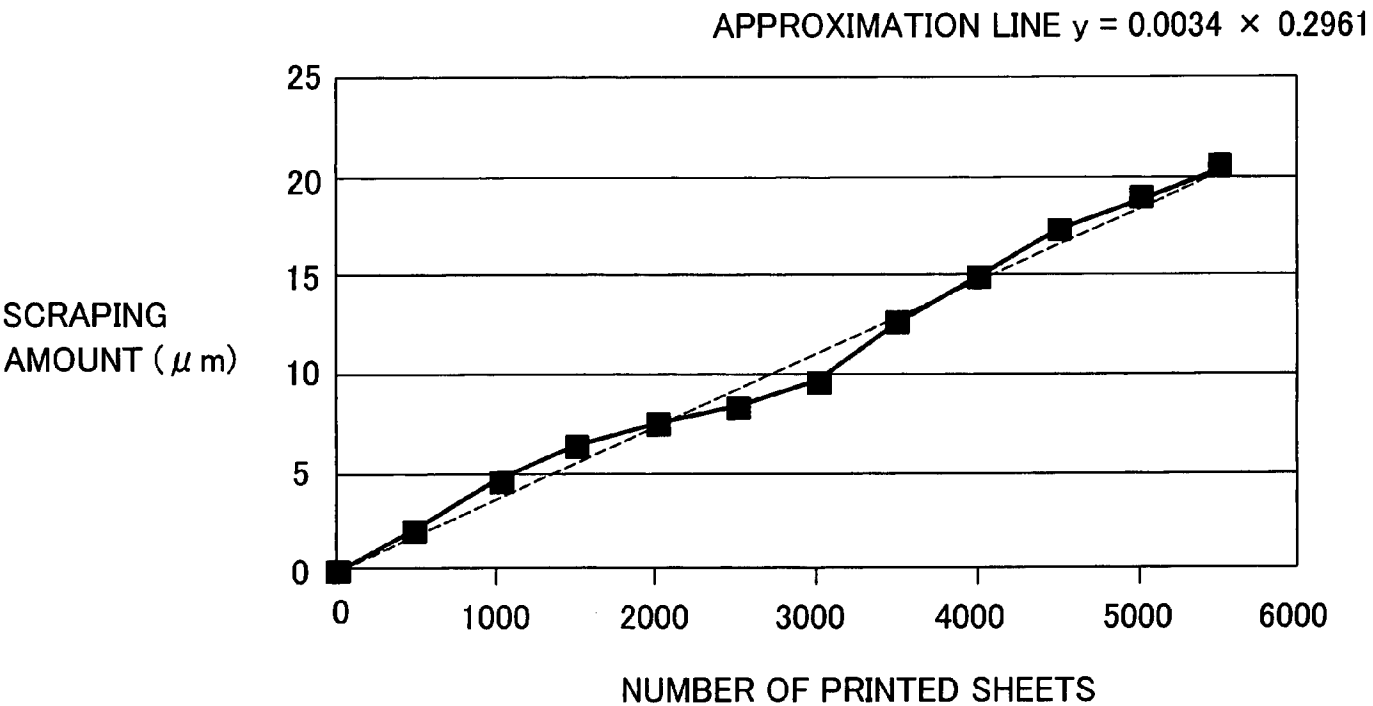
FIG. 10 is a graph showing a relation between the number of printed sheets and the scraping amount of the photoconductive layer.

For Silica B, silica having a BET specific surface area of 50 $m^2/g$ was used. To examine the effect of Silica B on the scraping amount of the photoconductive layer, a toner containing carbon black as colorant and 1% (wt %) of Silica B was prepared, and the relation between the number of printed sheets and the scraping amount of the photoconductive layer was measured at a developing roller nip pressure of 290 kPa. FIG. 10 shows this measurement result. FIG. 10 is a graph showing the relation between the number of printed sheets and the scraping amount of the photoconductive layer. The horizontal axis shows the number of printed sheets, and the vertical axis shows the scraping amount.

In FIG. 10, the scraping amount of the photoconductive layer tends to increase linearly with increase in the number of printed sheets. If an approximation relation is fitted to the measurement points on the graph, the following Equation 3 is obtained.

$$y=0.0034x+0.2961 \quad \text{[Equation 3]}$$

Based on Equation 3, the scraping amount of the photoconductive layer after printing 6000 sheets was computed as 20.7 μm.

Herein, as in the case of Silica A, it was confirmed that when Silica A and Silica B are not added (addition amount 0%), there is no scraping of the photoconductive layer, therefore concerning the equation representing the scraping amount of the photoconductive layer, there is no problem in assuming a linear plot passing through the origin shown in graph D of FIG. 9.

In practice, when the addition amounts of Silica A and Silica B are 0%, filming occurs so the intercept on graph D of FIG. 9 may be considered to be slightly negative, but herein, it will be assumed that a more stringent condition (intercept=0 μm) is used.

Hence, in graph D of FIG. 9, if y% of Silica B is added, the scraping amount of the photoconductive layer after printing 1000 sheets is given by the following Equation 4.

$$3.5y\ (\mu m) \quad \text{[Equation 4]}$$

In Equation 4, the coefficient of 3.5 is a coefficient obtained by converting the scraping amount of 20.7 μm per 6000 sheets, to 1000 sheets.

(iv) Contribution of Silica A and Silica B to Scraping Amount

From the above, when x% of Silica A and y% of Silica B were added and the developing roller nip pressure was set to 290 kPa, the contribution of Silica A and Silica B to the scraping amount of the photoconductive layer after printing 1000 sheets, is given by the following Equation 5.

$$1.4x+3.5y\ (\mu m) \quad \text{[Equation 5]}$$

(v) Iron Oxide Particles

Figure 11:
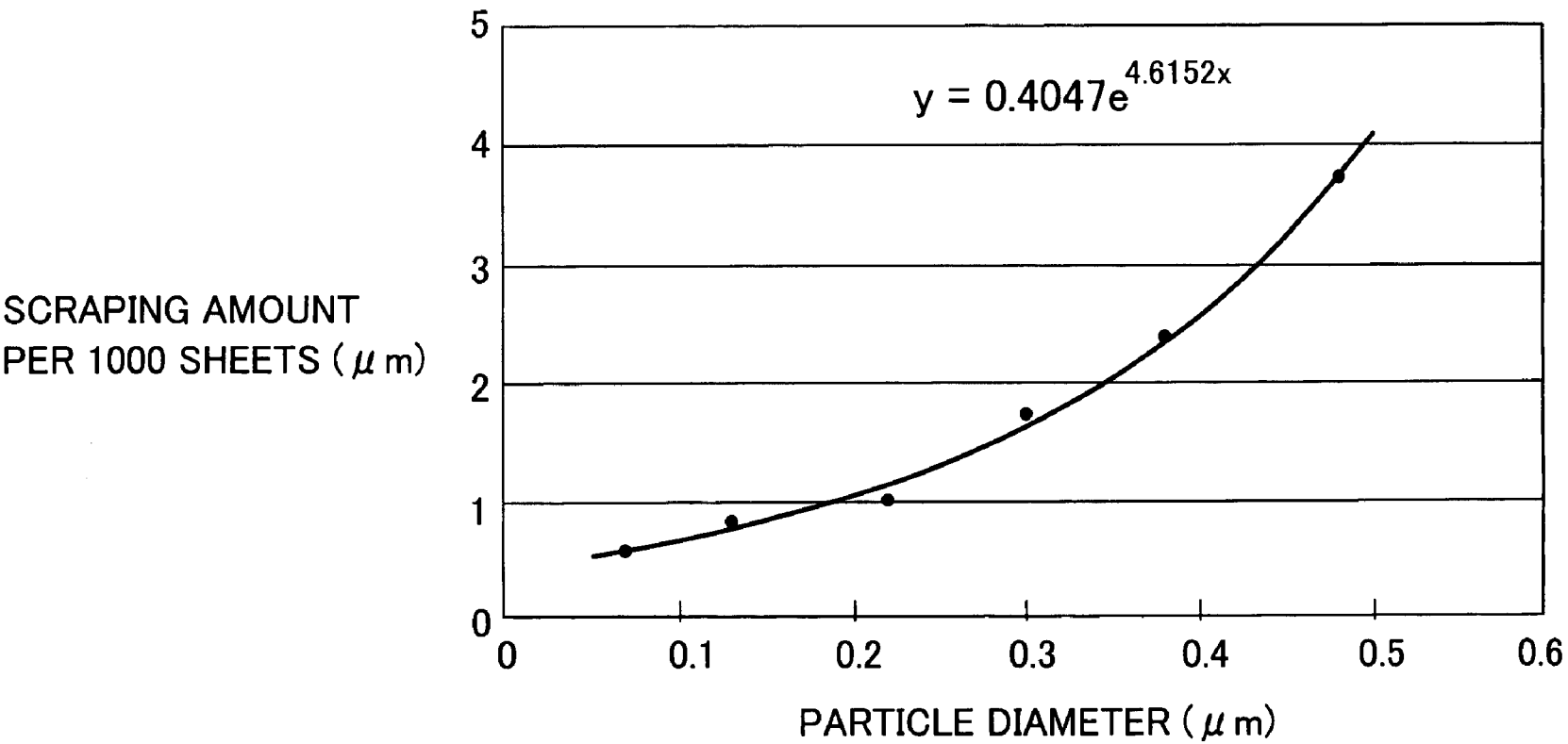
FIG. 11 is a graph showing a relation between a particle diameter of iron oxide particles and the scraping amount of the photoconductive layer.

To examine the effect of iron oxide particles on the scraping amount of the photoconductive layer, a toner was prepared containing 1% (wt %) of Silica A and 0.5% (wt %) of Silica B relative to polymer resin particles containing 6% (vol %) of iron oxide particles having various particle diameters, and the scraping amount of the photoconductive layer was measured after printing 1000 sheets using this toner at a developing roller nip pressure of 290 kPa. FIG. 11 shows this measurement result. FIG. 11 is a graph showing the relation between the particle diameter of the iron oxide particles and the scraping amount of the photoconductive layer. The horizontal axis shows the particle diameter of the iron oxide particles, and the vertical axis shows the scraping amount.

In FIG. 11, the scraping amount of the photoconductive layer tends to increase exponentially with increase in the particle diameter of the iron oxide particles. If an approximation relation is fitted to the measurement points on the graph, the following Equation 6 is obtained.

$$y=0.407e^{4.6152}x \quad \text{[Equation 6]}$$

Herein, based on Equation 6, if the particle diameter of the iron oxide particles is z (μm), the effect of the iron oxide particles on the scraping amount of the photoconductive layer after printing 1000 sheets is given by the following Equation 7.

$$0.405e^{4.62x}\ (\mu m) \quad \text{[Equation 7]}$$

(vi) Developing Roller Nip Pressure

Figure 12:
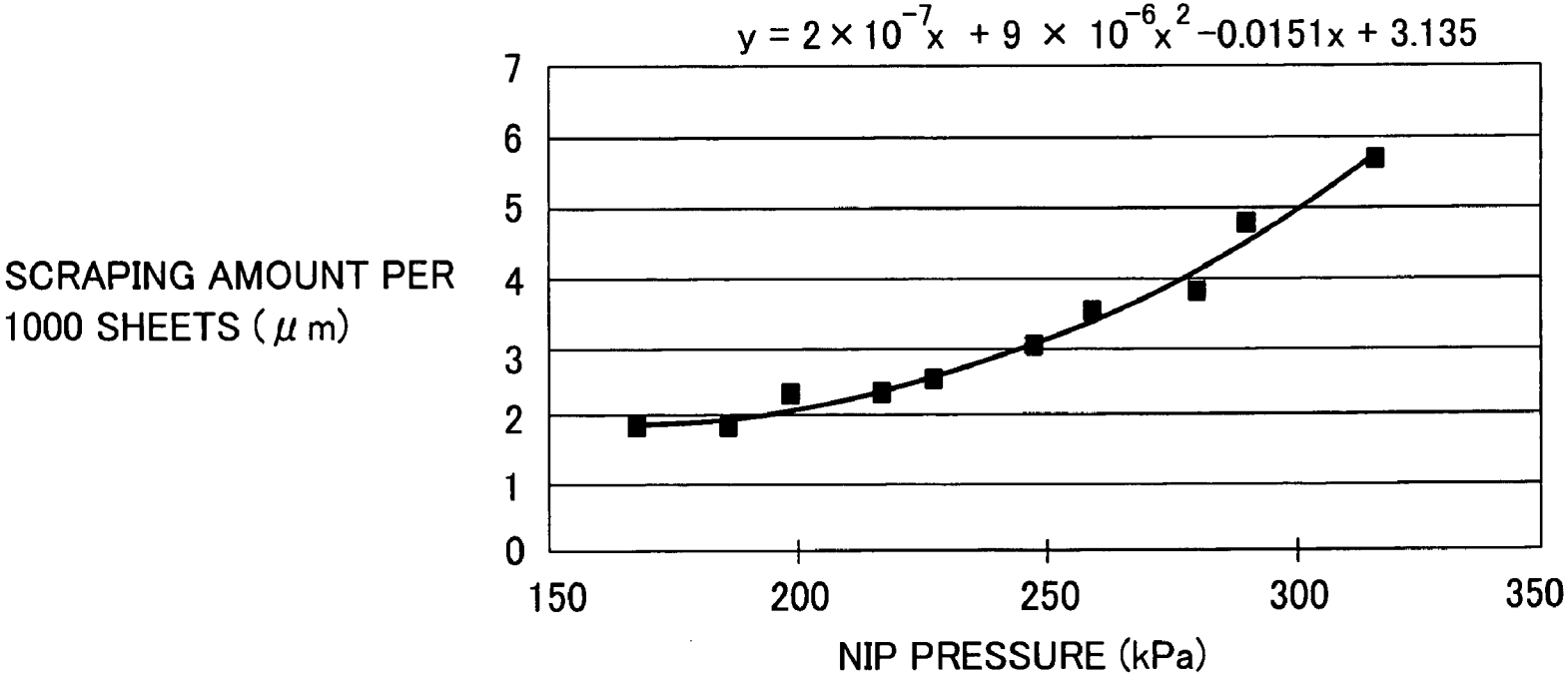
FIG. 12 is a graph showing a relation between a nip pressure of a developing roller and the scraping amount of the photoconductive layer.

To examine the effect of the scraping amount of the photoconductive layer based on the nip pressure of the developing roller on the photoconductive drum, a toner was prepared containing 0.5 wt % of Silica A and 0.5 wt % of Silica B relative to polymer resin toner particles containing iron oxide particles having a particle diameter of 0.3 μm, and the scraping amount of the photoconductive layer was measured after endurance printing of 1000 sheets using this toner while varying the developing roller nip pressure. FIG. 12 shows this measurement result. FIG. 12 is a graph showing the relation between the developing roller nip pressure and the scraping amount of the photoconductive layer. The horizontal axis shows the developing roller nip pressure, and the vertical axis shows the scraping amount.

In FIG. 12, the scraping amount of the photoconductive layer increases along a curve with increase of the developing roller nip pressure. If an approximation relation is fitted to the measurement points on the graph, the following Equation 8 is obtained.

$$y=2\times10^{-7}x^3+9\times10^{-6}x^2-0.151x+3.135 \quad \text{[Equation 8]}$$

Herein, Equation 5 and Equation 7 were both deduced for a developing roller nip pressure of 290 kPa. Calculating the scraping amount of the photoconductive layer for this nip pressure of 290 kPa from Equation 8, the scraping amount is 4.4 μm. Therefore, in Equation 8, in order to determine the scraping amount of the photoconductive layer per 1 kPa, Equation 8 may be divided by 4.4.

In other words, the scraping amount of the photoconductive layer corresponding to a developing roller nip pressure of 1 kPa(p) after printing 1000 sheets is represented by the following Equation 9.

$$2\times10^{-7}p^3+9\times10^{-6}p^2-0.151p+3.135/4.4\ (\mu m) \quad \text{[Equation 9]}$$

(vi) Based on the above description, using a toner containing x% (wt %) of Silica A and y% (wt %) of Silica B in polymer resin toner particles containing 6% (vol %) of iron oxide having a particle diameter of z μm, if 1000 sheets are printed at a developing roller nip pressure p (kPa), the scraping amount is given by the following Equation 10.

$$(1.4x+3.5y+0.405e^{4.62x})\times(2\times10^{-7}p^3+9\times10^{-6}p^2-0.151p+3.135)/4.4\ (\mu m) \quad \text{[Equation 10]}$$

Equation 10 gives the scraping amount per 1000 sheets, therefore if the number of printed sheets is s, the scraping amount per sheet is given by the following Equation 11.

$$(1.4x+3.5y+0.405e^{4.62z})\times(2\times10^{-7}p^3+9\times10^{-6}p^2-0.151p+3.135)/4.4\times(s/1000)\ (\mu m) \quad \text{[Equation 11]}$$

Herein, as described above, the lower limit of the film thickness of the photoconductive layer required to form an image is 10 μm, so if the initial film thickness of the photoconductive layer is t, the film thickness of the photoconductive layer remaining after scraping due to printing is given by (t−10). If the remaining film thickness (t−10) is larger than the scraping amount given by Equation 11, there is no problem for image-forming. Expressing this in the form of an equation, the following Equation 12 is obtained.

$$(1.4x+3.5y+0.405e^{4.62z})\times(2\times10^{-7}p^3+9\times10^{-6}p^2-0.151p+3.135)/4.4\times(s/1000)-(t-10)\leqq0\ (\mu m) \quad \text{[Equation 12]}$$

B. Relation Between Scraping Amount of Photoconductive Layer and Function Values (1) A toner was prepared varying the particle diameter of iron oxide particles (amount 6%, vol %) contained in the polymer resin particles, and the addition amounts of Silica A and Silica B, and the scraping amount of the photoconductive layer was measured by performing endurance printing of 10000 sheets using this toner while varying the developing roller nip pressure. The relation between the scraping amount and the function value (f) on the left-hand side of Equation 12 was examined.

Herein, the endurance printing test was performed with 10000 sheets because endurance printing of 5000 sheets is not a permitted level for current products, and several tens of thousands is too far removed from the tolerance level for current products.

(2) EXAMPLES (i) A toner was prepared varying the particle diameter of iron oxide particles (amount 6%, vol %) contained in the polymer resin particles, and the addition amounts of Silica A and Silica B, and endurance printing of 10000 sheets was performed using this toner while varying the developing roller nip pressure. The results are shown as Examples 1-6 in the following Table 2.

TABLE 2

| | | Nip Pressure (kPa) | Additive A (wt %) | Additive B (wt %) | Fe particle Diameter (μm) | F (x, y, z, l, p) | OPC film thickness Initial Value (μm) | OPC film thickness After Printing (μm) | |
|---|---|---|---|---|---|---|---|---|---|
| Example | 1 | 200 | 0.5 | 0.5 | 0.3 | −3.5 | 32.7 | 14.5 | |
| | 2 | 350 | 0.4 | 0 | 0.1 | −1.7 | 32.3 | 11.5 | Good results are obtained if additive and Iron oxide are low, even if nip pressure is high. |
| | 3 | 50 | 0.3 | 0 | 0.45 | −1.6 | 31.8 | 11.9 | Good results are obtained if nip pressure is low even if Fe diameter is large. |
| | 4 | 50 | 0 | 1.8 | 0.1 | −1.2 | 49.5 | 11.3 | Good results are obtained by controlling nip pressure, Fe diameter and initial film thickness even if additives are large. |
| | 5 | 50 | 2 | 1 | 0.1 | −1.7 | 50 | 11.1 | Good results are obtained by controlling nip pressure, Fe diameter and initial film thickness even if additives are large. |
| | 6 | 50 | 0.5 | 0 | 0.6 | −0.4 | 50 | 10.8 | Good results are obtained by controlling nip pressure and initial film thickness even if Fe diameter is large. |
| Comparative Example | 1 | 400 | 0.3 | 0 | 0.1 | 6.2 | 31.2 | 3.6 | Unsatisfactory results as nip pressure is too high. |
| | 2 | 50 | 6 | 0 | 0.1 | 11.2 | 48.7 | Printing stops midway, as film thickness is 0 μm. | Unsatisfactory results as additive amount is too large. |
| | 3 | 50 | 0 | 3 | 0.1 | 23.0 | 48.5 | Printing stops midway, as film thickness is 0 μm. | Unsatisfactory results as additive amount is too large. |
| | 4 | 50 | 3 | 1 | 0.1 | 7.5 | 48.5 | 2.8 | Unsatisfactory results as additive amount is too large. |
| | 5 | 50 | 0.5 | 0 | 0.8 | 54.4 | 49.5 | Printing stops midway, as film thickness is 0 μm. | Fe diameter is large, unsatisfactory results. |

(ii) In Example 1, a toner was used wherein the addition amount of Silica A was 0.5%, the addition amount of Silica B was 0.5% and the particle diameter of the iron oxide contained in the polymer resin particles was 0.31 μm, and the developing roller nip pressure was 200 kPa. The initial film thickness of the photoconductive layer was 32.7 μm, and the film thickness after printing 10000 sheets was 14.5 μm. Due to this, the scraping amount of the photoconductive layer was 18.2 μm. The function value f was −3.5, and the conditions of Equation 12 were satisfied.

In this case, based on the fact that the addition amounts of Silica A and Silica B, the particle diameter of iron oxide and the developing roller nip pressure are within satisfactory ranges, good results were obtained.

(iii) In Example 2, a toner containing 0.4% of Silica A but no Silica B, wherein the particle diameter of iron oxide contained in the polymer resin particles was 0.1 μm, was used, and the developing roller nip pressure was set to 350 kPa. The initial film thickness of the photoconductive layer was 32.3 μm, and the film thickness after printing 10000 sheets was 11.5 μm. Due to this, the scraping amount of the photoconductive layer was 20.8 μm. The function value f was −1.7, and the conditions of Equation 12 were satisfied.

In this case, the developing roller nip pressure was set high to 350 kPa, but as the BET specific surface area of Silica A was 100 $m^2/g$, its particle diameter was small and the particle diameter of iron oxide was small, i.e., 0.1 μm, good results were obtained.

(iv) In Example 3, a toner containing 0.3% of Silica A but no Silica B, wherein the particle diameter of iron oxide contained in the polymer resin particles was 0.45 μm, was used, and the developing roller nip pressure was set to 50 kPa. The initial film thickness of the photoconductive layer was 31.8 μm, and the film thickness after printing 10000 sheets was 11.9 μm. Due to this, the scraping amount of the photoconductive layer was 19.9 μm. The function value f was −1.6, and the conditions of Equation 12 were satisfied.

In this case, the particle diameter of iron oxide particles was large, i.e., 0.45 μm, but as the developing roller nip pressure was low, i.e., 50 kPa, good results were obtained.

(v) In Example 4, a toner containing no Silica A and 1.8% Silica B, wherein the particle diameter of iron oxide contained in the polymer resin particles was 0.1 μm, was used, and the developing roller nip pressure was set to 50 kPa. The initial film thickness of the photoconductive layer was 49.5 μm, and the film thickness after printing 10000 sheets was 11.3 μm. Due to this, the scraping amount of the photoconductive layer was 38.2 μm. The function value f was −1.2, and the conditions of Equation 12 were satisfied.

In this case, the addition amount of Silica B was high, i.e., 1.8%, but as the developing roller nip pressure was low, i.e., 50 kPa, the particle diameter of iron oxide was small, i.e., 0.1 μm and the initial film thickness of the photoconductive layer was thick, i.e., 49.5 μm, good results were obtained due to initial film thickness control.

(vi) In Example 5, a toner containing 2% of Silica A and 1% of Silica B, wherein the particle diameter of iron oxide contained in the polymer resin particles was 0.1 μm, was used, and the developing roller nip pressure was set to 50 kPa. The initial film thickness of the photoconductive layer was 50 μm, and the film thickness after printing 10000 sheets was 11.1 μm. Due to this, the scraping amount of the photoconductive layer was 38.91 μm. The function value f was −1.7, and the conditions of Equation 12 were satisfied.

In this case, the addition amount of Silica A was 2% and the addition amount of Silica B was 1% so the overall addition amount was large, the developing roller nip pressure was low, i.e, 50 kPa, the particle diameter of iron oxide was small, i.e., 0.1 μm and the initial film thickness of the photoconductive layer was thick, i.e, 50 μm, so good results were obtained due to initial film thickness control.

(vii) In Example 6, a toner containing 0.5% of Silica A but no Silica B, wherein the particle diameter of iron oxide contained in the polymer resin particles was 0.6 μm, was used, and the developing roller nip pressure was set to 50 kPa. The initial film thickness of the photoconductive layer was 50 μm, and the film thickness after printing 10000 sheets was 10.8 μm. Due to this, the scraping amount of the photoconductive layer was 39.2 μm. The function value f was −0.4, and the conditions of Equation 12 were satisfied.

In this case, the particle diameter of iron oxide was large, i.e., 0.6 μm, the developing roller nip pressure was low, i.e., 50 kPa and the initial film thickness of the photoconductive layer was thick, i.e., 50 μm, so good results were obtained due to initial film thickness control.

(3) COMPARATIVE EXAMPLES (i) A toner was prepared varying the particle diameter of iron oxide particles (amount 6%, vol %) contained in the polymer resin particles, and the addition amounts of Silica A and Silica B, and endurance printing of 10000 sheets was performed using this toner while varying the developing roller nip pressure. The results are shown as Comparative Examples 1-5 in the Table 2.

(ii) In Comparative Example 1, a toner containing 0.3% of Silica A but no Silica B, wherein the particle diameter of iron oxide contained in the polymer resin particles was 0.1 μm, was used, and the developing roller nip pressure was set to 400 kPa. The initial film thickness of the photoconductive layer was 31.2 μm, and the film thickness after printing 10000 sheets was 3.6 μm. Due to this, the scraping amount of the photoconductive layer was 27.6 μm. The function value f was 31.2, and the conditions of Equation 12 were not satisfied.

In this case, the developing roller nip pressure was too high, so good results were not obtained.

(iii) In Comparative Example 2, a toner containing 0.6% of Silica A but no Silica B, wherein the particle diameter of iron oxide contained in the polymer resin particles was 0.1 μm, was used, and the developing roller nip pressure was set to 50 kPa. The initial film thickness of the photoconductive layer was 48.7 μm, and the film thickness after printing 10000 sheets was 0 μm. The function value f was 11.2, and the conditions of Equation 12 were not satisfied.

In this case, the addition amount of Silica A was too high, so good results were not obtained.

(iv) In Comparative Example 3, a toner containing no Silica A and 3% Silica B, wherein the particle diameter of iron oxide contained in the polymer resin particles was 0.1 μm, was used, and the developing roller nip pressure was set to 50 kPa. The initial film thickness of the photoconductive layer was 48.5 μm, but the film thickness of the photoconductive layer during endurance printing of 10000 sheets was 0 μm, so printing stopped midway during the operation. The function value f was 23.0, and the conditions of Equation 12 were not satisfied.

In this case, the addition amount of Silica B, which had a large particle diameter (BET specific surface area 50 $m^2/g$), was too large, so good results were not obtained.

(v) In Comparative Example 4, a toner containing 3% of Silica A and 1% of Silica B, wherein the particle diameter of iron oxide contained in the polymer resin particles was 0.1 μm, was used, and the developing roller nip pressure was set to 50 kPa. The initial film thickness of the photoconductive layer was 48.7 μm, but the film thickness of the photoconductive layer during endurance printing of 10000 sheets was 0 μm, so printing stopped midway during the operation. The function value f was 11.2, and the conditions of Equation 12 were not satisfied.

In this case, the addition amount of Silica A was large, and 1% of Silica B which had a large particle diameter was also added, so the total addition amount of silicas A and B was too large, and good results were not obtained.

(vi) In Comparative Example 5, a toner containing 0.5% of Silica A but no Silica B, wherein the particle diameter of iron oxide contained in the polymer resin particles was 0.8 μm, was used, and the developing roller nip pressure was set to 50 kPa. The initial film thickness of the photoconductive layer was 49.5 μm, but the film thickness of the photoconductive layer during endurance printing of 10000 sheets was 0 μm, so printing stopped midway during the operation. The function value f was 54.4, and the conditions of Equation 12 were not satisfied.

In this case, the particle diameter of iron oxide particles was 0.8 μm, which is too large, so good results were not obtained.

As described above, according to the electrostatic developing toner of the second embodiment, even when images are formed after printing about 10000 sheets, scraping of the photoconductive layer on the photoconductive drum due to image-forming can be suppressed to below a fixed amount.

What is claimed is:

1. A developing unit utilized in an image-forming apparatus with a photoconductive drum on a circumferential surface of which a photoconductive film is formed, an electrostatic latent image being formed on the photoconductive film, the developing unit comprising:

a non-magnetic developing roller for charging and supplying an electrostatic developing toner to the electrostatic latent image formed on the photoconductive film while contacting with the photoconductive film on the photoconductive drum to develop the electrostatic latent image;

wherein the electrostatic developing toner comprises iron oxide particles in resin particles, the iron oxide particles functioning as a colorant the amount of the iron oxide particles relative to the toner is 4-7vol %, and the ratio (d/D) between the average particle diameter D of the electrostatic developing toner and the average particle diameter d of the iron oxide particles, is within the range of 0.01-0.03.

2. The developing unit according to claim 1, wherein the retentivity Hc of the iron oxide particles is 3-7 kA/m in a magnetic field of 79.6 kA/m, and the ratio (σr/σs) of the residual magnetization σr to the saturation magnetization σs is 0.3 or less.

3. The developing unit according to claim 1, wherein the iron oxide particle has a spherical shape.

4. A developing unit utilized in an image-forming apparatus with a photoconductive drum on a circumferential surface of which a photoconductive film is formed, an electrostatic latent image being formed on the photoconductive film, the developing unit comprising:

a non-magnetic developing roller for charging and supplying an electrostatic developing toner to the electrostatic latent image formed on the photoconductive film while contacting with the photoconductive film on the photoconductive drum to develop the electrostatic latent image;

wherein the electrostatic developing toner comprises iron oxide particles in resin particles, the amount of the iron oxide particles relative to the toner is 4-7vol %, the iron oxide particles have a retentivity of 3-7 kA/m in a magnetic field of 79.6 kA/m, and the ratio (σr/σs) of the residual magnetization σr to the saturation magnetization σs is 0.3 or less.

5. The developing unit according to claim 4, wherein the iron oxide particle has a spherical shape.

6. A developing unit utilized in an imager-forming apparatus, the developing unit comprising:

a non-magnetic developing roller for charging and supplying an electrostatic developing toner to an electrostatic latent image formed on a photoconductive medium while contacting with the photoconductive medium to develop the electrostatic latent image;

wherein the electrostatic developing toner comprises iron oxide particles in resin particles, the iron oxide particles functioning as a colorant, the amount of the iron oxide particles relative to the toner is 4-7vol %, and the ratio (d/D) between the average particle diameter D of the electrostatic developing toner and the average particle diameter d of the iron oxide particles, is within the range of 0.0 1-0.03.

* * * * *